United States Patent [19]

Kennedy, Jr.

[11] Patent Number: 4,630,654

[45] Date of Patent: Dec. 23, 1986

[54] APPARATUS FOR LIQUID FILLING OF CONTAINERS

[75] Inventor: Conrad P. Kennedy, Jr., Beaumont, Tex.

[73] Assignee: Patrick Howard Gibson, Sweeney, Tex.

[21] Appl. No.: 640,003

[22] Filed: Aug. 10, 1984

[51] Int. Cl.[4] ..... B65B 3/04

[52] U.S. Cl. ..... 141/83; 141/94; 141/128; 141/192; 141/286

[58] Field of Search ..... 141/83, 94, 95, 96, 141/128, 198, 192, 285, 286, 250–284

[56] References Cited

U.S. PATENT DOCUMENTS 4,211,263 7/1980 Kennedy et al. ..... 141/128

4,337,802 7/1982 Kennedy et al. ..... 141/128

*Primary Examiner*—Houston S. Bell, Jr.

*Attorney, Agent, or Firm*—Browning, Bushman, Zamecki & Anderson

[57] ABSTRACT

An apparatus for filling a container with a liquid to a predetermined weight which utilizes a scale which generates a control signal which is based on the weight of liquid within the container, a control valve such as a ball valve having a valve element which permits a selectively variable flow rate through the valve, an actuator which is operatively connected to the control valve to vary the position of the valve element and thereby vary the flow rate, a valve positioner to control the operation of the actuator/valve in response to a calculated positioning signal which is related to the control signal and which is generated by an interface arrangement operatively connected to the scale and the positioner. The apparatus further includes a conduit assembly for introducing liquid into the container, the filling assembly including a generally hook-shaped filling lance which is pivotally mounted for rotation about a generally horizontal axis and which can be moved to a liquid discharge position wherein liquid discharged therefrom is directed generally downwardly thereby permitting the filling of foaming liquids without the necessity for subsurface filling. There is also included a fume disposal assembly and a drip collection assembly for the lance being contained within the fume disposal assembly, the drip collection assembly serving to catch any drops of liquid from the lance.

15 Claims, 3 Drawing Figures

TO VACUUM
3
3
30
54
28b
44
34
42
40
38
60
52
32
37
36
58a
58
48a
48
48b
62
56
12a
12
48c
49
64

APPARATUS FOR LIQUID FILLING OF CONTAINERS

BACKGROUND OF THE INVENTION

The present invention relates to an apparatus for filling containers with a predetermined weight of liquid and, more particularly, to such an apparatus employing an improved filling lance and interfacing arrangement wherein the liquid is introduced into the container at a rate based on the weight of the liquid already in the container and a flow control equation or program.

The filling of containers with a liquid to a predetermined or desired weight is generally carried out, depending upon the type of liquid, in one of two fill cycles: in the first type of fill cycle, which can be described as "fast-slow-off," the liquid is initially introduced into the container at a relatively high filling rate until a predetermined weight of liquid has been introduced into the container at which point the remaining portion of liquid is admitted at a second, slower fill rate. The first, faster filling rate is known in the art as "fast fill" while the second, slower filling rate has been termed "dribble fill." When the desired weight of liquid has been introduced into the container, the dribble fill is terminated, completing the cycle.

The second type of fill cycle can be termed "slow-fastslow-off." This type of fill cycle is commonly employed with liquids such as detergents or other liquids which easily foam such that if the liquid were initially introduced at a high fill rate into an empty container, the foaming liquid would be forced out of the fill opening of the container resulting in a messy and hazardous work environment. A particularly hazardous environment can exist in the case where the liquid is of a type which not only foams but which also may be quite toxic, such as an insecticide, herbicide or the like. To accommodate such foaming liquids, and for other reasons, it is common to use what is known as "subsurface fill" wherein the conduit or filling lance is inserted into the container for a distance such that the emission end of the conduit or lance is disposed just above the bottom of the container. The liquid is then introduced into the container at a dribble fill rate until a level of liquid is reached in the container such that the emission end of the lance is below the surface of the liquid. At this point, the liquid may then be introduced at a fast fill rate until a predetermined weight of liquid is reached. At this point, dribble flow rate is again used to bring the volume of liquid introduced into the container to the desired fill rate. At this point, the fill cycle is complete and the flow of liquid is stopped.

Examples of prior art apparatus for carrying out liquid filling of containers include U.S. Pat. Nos. 4,211,263 and 4,337,802, both of which to Applicant's knowledge represent the closest prior art.

There are numerous problems associated with the prior art apparatus such as described in the aforementioned patents. In order to carry out either of the two fill cycles described above, the prior art systems have either employed two valves, one for fast fill and one for dribble fill, or, alternatively, have used a single valve with three positions, i.e. fully closed, fully open and selectable intermediate. Filling apparatus employing such valve assemblies are bulky, complicated to construct and maintain and require extensive logic circuitry if the apparatus is to be used for the automatic filling of containers. Moreover, because the prior art systems require a dribble fill mode in order to prevent overshooting the desired weight of liquid in the container, there is a necessary loss of efficiency because of the time consuming dribble fill. Another problem with such prior art systems is that because for accuracy with optimum efficiency, they must fill the bulk of the liquid in a fast fill mode and then switch to a second slower, dribble fill mode, there is a necessity to have a fast valve closure lest there be an inadvertent overfill. Over and above the added expense of providing such a fast close valve system, such systems inherently produce a water hammer effect in the liquid feed line leading to the fill apparatus. As is well known to those skilled in the art, the water hammer effect is undesirable as it puts unnecessary stresses on flow lines, valves and fittings. Moreover, there is always the possibility of a line or fitting rupture caused by the instantaneous pressure build up with the result that a serious spill of liquid can occur.

The prior systems such as disclosed in the aforementioned U.S. patents present serious disadvantages when subsurface filling is necessary. In prior art subsurface fill operations, the filling lance is normally withdrawn from the container at a rate which maintains the end of the lance below the liquid surface in the container. Operator withdrawal of the lance results in some inaccuracy in the final fill weight since there is a tendency to withdraw the lance slower than necessary to avoid breaking the surface of the liquid. On the other hand, in systems wherein the movement of the lance is automatically controlled at the various stages in the filling process, such as the withdrawal during a subsurface fill operation, it requires expensive logic circuitry, limit switches and associated equipment all of which is expensive to manufacture and relatively complicated to maintain. Additionally, such automated systems wherein the lance is automatically withdrawn require a movable carriage mounted on a suitable track system which will move the lance, the valve and the peripheral equipment in a vertical reciprocating fashion so that the lance may be inserted and withdrawn from the fill opening of the container. It will be appreciated that such an apparatus wherein an elongate fill lance must be moved vertically so as to clear the top of the container will be bulky, and require a large amount of overhead space.

Prior art filling systems have also generally required movable, programmable drip pan assemblies to catch liquid drops from the withdrawn lance to avoid either spillage onto the container and surroundings or overfill of the container, elaborate fume hood assemblies to control noxious vapors, and wiper rings, in the case of subsurface filling, to remove excess liquid from the exterior surface of the lance as it is withdrawn from the filling container. Lastly, to ensure accuracy in the filling of the containers, more modern prior art devices have utilized a foot valve assesmbly to prevent liquid which is contained in the filling lance from emptying into the container after the main control valve has been closed.

SUMMARY OF THE INVENTION

It is therefore an object of the present invention to provide an improved liquid filling apparatus which is simple in construction, provides accurate, fast filling, can dispense foaming liquids without the necessity for subsurface filling and provides a safe, accurate and efficient handling of toxic or noxious liquids in a filling operation.

Another object of the present invention is to provide an improved conduit assembly for filling containers with a liquid to a predetermined weight, the conduit assembly including a unique lance which obviates the need for subsurface filling, even of foaming liquids.

The above and other objects of the present invention will become apparent from the drawings, the description given herein and the appended claims.

There is provided by the present invention, in an apparatus for filling a container to a predetermined weight with a liquid from a liquid source and having a weighing system and a control valve system in flow controlling relationship between the liquid source and the container, an improved conduit assembly for introducing liquid into the container comprising a support means for mounting the conduit assembly, a filling lance having a first run portion interconnected to a second run portion, the first run portion being completely disposed with respect to the second run portion, the filling lance being mounted for pivotal movement about a generally horizontal axis transverse to the first run portion and extending generally through the end of the first run portion distal the second run portion. The second run portion has a free end distal the first run portion and a discharge opening whereby the filling lance can be moved to a position such that liquid is discharged through the discharge opening in a generally downward path. Preferably, the lance is hook-shaped, a J-shaped lance being especially preferred.

In another embodiment, the present invention relates to an apparatus for filling a container to a predetermined weight with a liquid from a liquid source. The apparatus includes a scale or weighing means for generating a control signal based on the weight of liquid in the container, a control valve means disposed between the liquid source and the container and being of a type, e.g. a ball valve, permitting a variable flow rate therethrough, and an actuator means which is connected to the control valve for moving the control valve element to vary the flow rate. The apparatus is also provided with a valve positioner operatively connected to the valve/actuator train so as to control operation of the actuator and hence position of the valve element in response to a calculated positioning signal which is based on the weight of liquid in the container and a control equation and which is generated by an interface arrangement, including a computer, operatively associated with the scale means and the positioner. The apparatus also include a conduit assembly, as described above, for introducing liquid into the container and which is in flow communication with the control valve means. Additionally, there are means for pivoting the lance and a means to supply liquid to the conduit assembly from the liquid source.

DESCRIPTION OF THE PREFERRED EMBODIMENT

Figure 1:
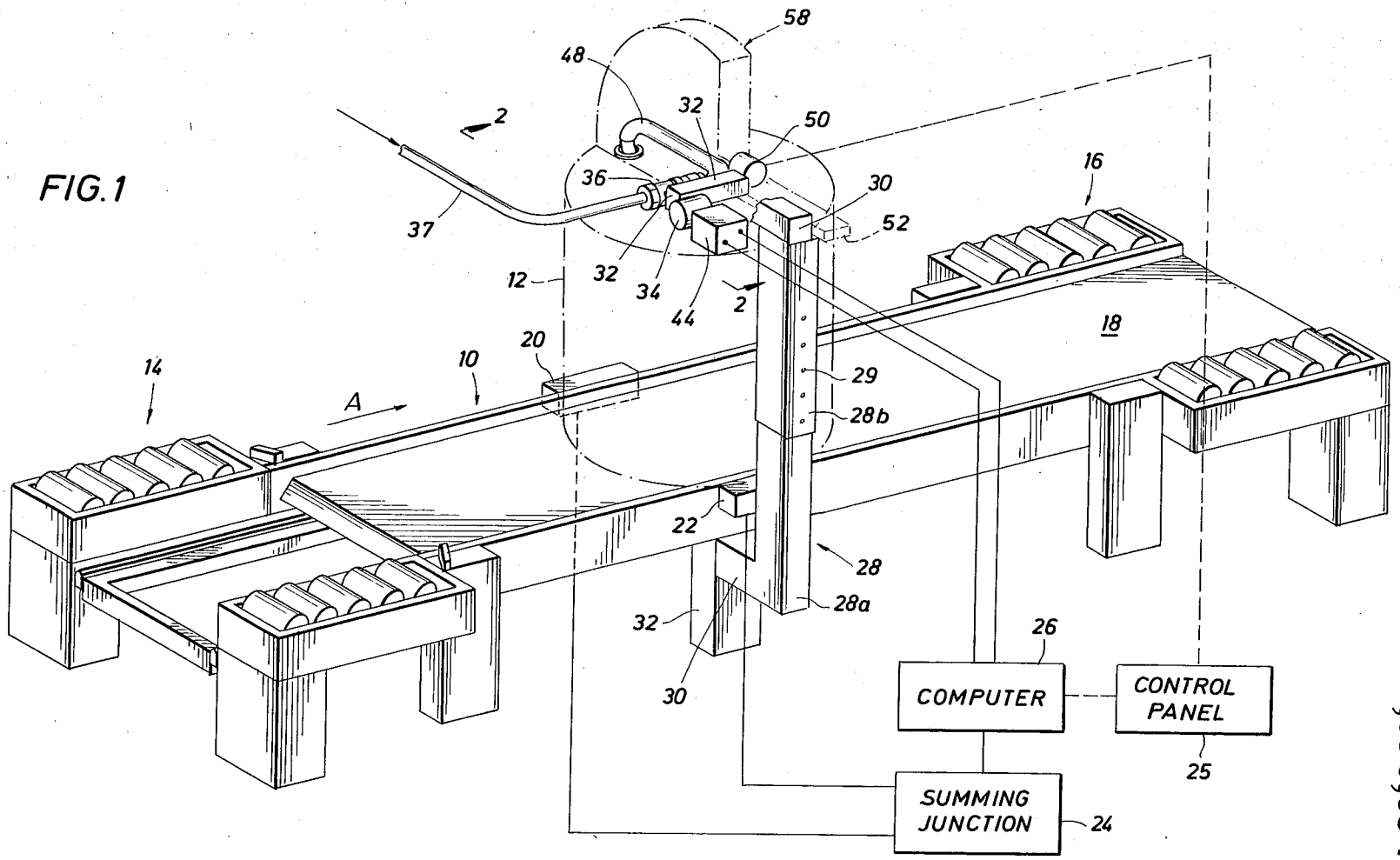
FIG. 1 is a perspective view of the improved filling apparatus of the present invention shown in combination with a unique conveyor system of the walking beam type.

Referring first to FIG. 1, there is shown a perspective view of the filling apparatus of the present invention including a weighing-conveying system, a drum to be filled (in phantom) and the associated valving, filling lance and inter facing arrangement used to control the filling operation. The weighing-conveying apparatus is that described and claimed in U.S. patent application Ser. No. 06/510,879, filed July 5, 1983, incorporated herein by reference for all purposes. The conveying apparatus designated generally as 10 translates the containers 12 in a step-wise fashion, i.e. in discreet intervals, along the path of movement indicated by the arrow A. While a detailed description of the conveyor 10 and its operation can be obtained from the aforementioned patent application, suffice to say that the conveyor is, generally speaking, of the walking beam type and includes a feed in roller assembly 14 and a feed out roller assembly 16, the conveying system using an escapement mechanism which permits sequencing of the containers 12 onto the movable platform 18 of the conveyor system, all of which are described in detail in the aforementioned patent application. Thus, a container such as 12 initially resting on feed in roller assembly 14 can be translated in a stepwise, discreet increment fashion in the direction of arrow A along platform 18 and be ultimately deposited on feed out roller assembly 16 after it has been filled at the weigh and fill station as hereafter described.

As set forth in the aforementioned patent application, the weighing means includes a pair of load cells 20, 22 which are in reality strain gauges of the shear beam type which are secured to the conveyor assembly 10 and which are positioned such that the container 12 is positioned thereon at one point in its movement in the path of direction shown by arrow A. Each of the load cells 20, 22 generates an analog signal proportional to the force applied to it by each drum, i.e. proportional to the weight of the drum and the liquid therein, the combined analog signals being sent to a summing junction 24, the common analog output signal from summing junction 24 being digitized and then converted to an analog output signal based on the analog input and a control equation in computer 26. Thus, it can be seen that the interfacing arrangement comprised of summing junction 24 and computer 26 constitute an analog-to-digital-to-analog (ADA) converter, with a feedback loop, supplying an output signal which is calculated using the input signal from load cells 20, 22, which in turn reflects the liquid weight in container 12. A control panel 25 operatively connected to computer 26 contains logic circuitry and other necessary instrumentation to automatically carry out the filling function as will be seen hereafter.

An adjustable, vertical support member 28 having fixed section **28*a* and movable, telescoping section 28*b* is secured to conveyor weighing system 10 by cross beam 30 which in turn is secured to a vertical foot 32 secured to conveyor-weighing system 10. Section 28*b* is slidable along section 28*a* and can be fixed to a desired height by means of a pin (not shown) received in a series of vertically spaced, registering holes 29 in sections 28*a* and 28*b*. It will be understood that other means can be used to make support 28 adjustable to various heights such as, for example, the use of a pneumatic or hydraulic piston and cylinder arrangement, a simple screw drive, etc. It will also be appreciated that while it is not absolutely necessary that support member 28** be vertically adjustable, it is an especially desirable feature since it permits the filling apparatus of the present invention to be easily adjustable to accommodate containers of virtually any size.

Support member 28 extends upwardly above platform 18 and adjacent conveying system 10 so as to be positioned generally along side container 12 when container 12 has been moved to the weigh station, i.e. over load cells 20, 22, as shown in FIG. 1. Secured to movable section 28*b*, as by welding (see FIG. 2), is a generally horizontally extending support arm 30, arm 30 extending generally over platform 18. Secured, as by welding, to the underside of support arm 30 is a cross piece 32, support arm 30 and cross piece 32 being conveniently constructed of tubular metal. Secured to one side of cross piece 32 is a valve actuator 34. Also secured to cross piece 32 on the opposite side from actuator 34 is a control valve 36 having a neck portion 38 which is secured in a convenient manner to cross piece 32 such that a valve stem 40 used to rotate a movable valve element (not shown) in valve 36 extends through an opening in tubular cross piece 32. Also extending into tubular cross piece 32 is the shaft 42 of actuator 34, shaft 42 and stem 40 being fixed together so as to rotate in unison. Secured to actuator 34 and operatively associated therewith is a valve positioner 44, valve positioner 44 also being operatively connected to the interfacing arrangement comprised of summing junction 24 and computer 26. A flexible, liquid feed line 37 from a source of liquid (not shown) is connected to valve 36 whereby liquid may be introduced via valve 36 into container 12.

Valve 36 is of the type having a movable valve element which varies the flow area of the orifice through the valve and thus can provide a virtually continuously variable flow rate, examples of such valves being ball valves, butterfly valves, globe valves, etc, ball valves being preferred. Actuator 34 may be any of many well known valve actuators of the pneumatic, electric or hydraulic type. Non-limiting examples of suitable types of actuators include spring and diaphragm actuators, pressure balanced diaphragm actuators, pressure balanced piston actuators, etc. A desirable actuator is a pneumatic, spring and diaphragm type employing a fail-safe spring return. The valve positioner, which in reality is a closed-loop controller, utilizes, as an input signal, the output signal from computer 26 and supplies an output signal in the form of diaphragm pressure to actuator 34, feedback being supplied from the valve stem 40. The basic purpose of positioner 44 is to assure a valve stem position, i.e. flow area of the valve orifice, which is in relation to the output signal from computer 26.

Connected to valve 36 is a conventional swivel joint 46 providing fluid flow thereto. A filling lance or conduit shown generally at 48 is connected to swivel joint 46. Lance 48, which is generally hook-shaped, comprises a front run or longer leg portion 48*a*, an intermediate, radiused leg portion 48*b* and a second run, shorter leg portion 48*c* (see FIG. 2), first run portion 48*a* and second run portion 48*c* being at an acute angle with respect to one another. Lance 48 is mounted, via swivel connector 46, so as to be pivotal about a generally horizontal axis running generally transverse to longer leg portion 48*a* and extending approximately through the end of longer leg portion 48a distal intermediate leg portion 48*b*, and accordingly distal second run portion 48*c*. Thus, lance 48 can be selectively moved or pivoted between the positions shown in full and in phantom in FIG. 2.

Figure 2:
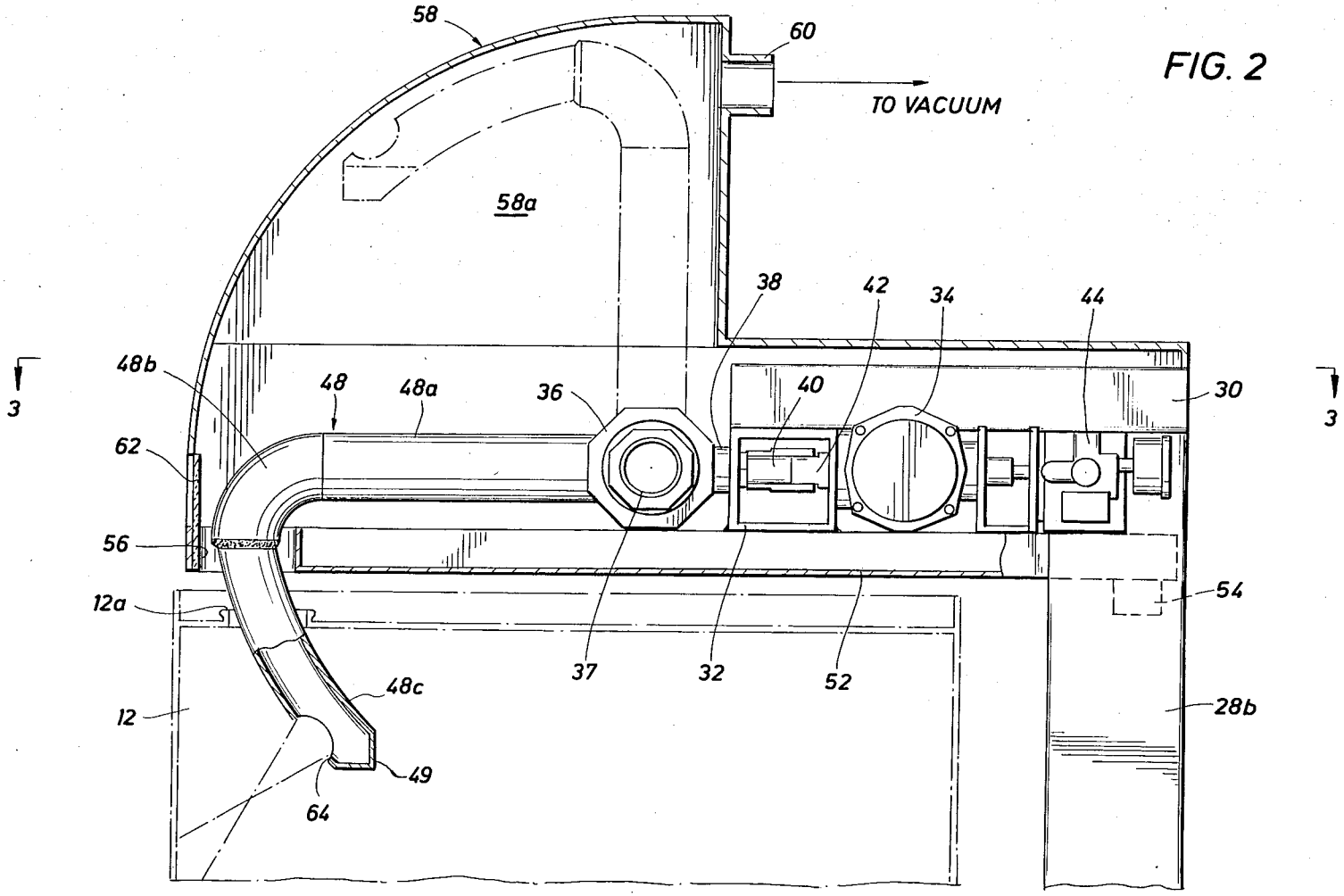
FIG. 2 is a view taken along the line 2—2 of FIG. 1 and shows the operation of the filling lance of the present invention.

A quarter turn rotary actuator 50 secured to cross brace 32 is connected to lance 48 and is operative to rotate or pivot lance 48 about swivel joint 46 between the positions shown in full and in dotted in FIG. 2. Rotary turn actuator 50 is also operatively connected to control panel 25 so as to be suitably sequenced into rotating lance 48 to the proper position.

Secured to the underside of cross piece 32 is a drip tray 52 having a drain outlet 54. Drip tray 52 is positioned so as to be generally below lance 48 when lance 48 is moved to the position shown in phantom in FIG. 2. To permit lance 48 to be moved to the position shown in full in FIG. 2, i.e. to the fill position, drip tray 52 is provided with an opening 56 whereby when lance 48 is pivoted downwardly, shorter leg 48*c* will extend through opening 56 as shown in FIG. 2. With particular reference to FIG. 2, it can be seen that the filling apparatus also includes a fume hood shown generally as 58 having an exhaust outlet or vent 60 which can be attached to a suitable source of vacuum (not shown) to evacuate fumes or vapors accumulating in hood 58. Hood 58 rests on and cooperates with drip tray 52 to generally provide an enclosure for lance 48 such that any liquid drops from lance 48 can be removed through drain 54 while any fumes from liquid in drip tray 52 can be recovered via vent (not shown). Hood 58 is also provided with a window 60 for visual inspection of the interior of hood 58, drip tray 52 and lance 48. Additionally, an operator can see if lance 48 and bung or fill opening 12*a* in container 12 are in alignment.

It will thus be seen that the entire assemblage comprised of actuator 34, valve 36, positioner 44, hood 58, drip tray 52 and lance 48 can be moved, as a unit, vertically to accommodate containers of varying height simply by adjusting the vertical height of movable section 28*b* relative to fixed section 28*a* of vertical support 28.

In operation, in response to a suitable start signal from panel 25, a drum 12 would be moved by conveyor system 10 and be positioned on load cells 20, 22, i.e. at the weigh station. With suitable positioning, bung 12*a* will then be in register with opening 56 in a drip tray 52. At this point, in response to a signal from panel 25 and with lance 48 in the quiescent position, i.e. that shown in phantom in FIG. 2, rotary actuator 50 would be engaged to move lance 48 from the position shown in phantom in FIG. 2 to the position shown in full in FIG. 2. Thus, the shorter leg portion 48*c* of lance 48 would be received in container 12 through bung 12*a*. Responsive to a start fill signal from panel 25, valve 36 will be opened by actuator 34 and liquid from a suitable liquid source (not shown) will pass through feedline 37, valve 36, swivel joint 46 and into lance 48. Initially, enough liquid is introduced into the container until a preselected amount has been reached, the preselected amount acting as a "control or feedback parameter" to use in the control equation for calculating, during the fill cycle, desired increases and decreases of flow rate.

With reference to FIG. 2, it can be seen that the second run or shorter leg 48*c* of lance 48 is provided with a discharge opening 64 which is located closely adjacent the free end 49 of 48*c* which is distal portion 48*a* and which faces away from the second run, longer leg portion 48*a*. Accordingly, and because of the generally hook-shaped configuration of lance 48, liquid being discharged into container 12 from lance 48 will follow a general downward flow path (as shown in FIG. 2) generally following the inside wall of container 12. Because of this unique liquid discharge flow pattern, liquids which would normally have a tendency to foam will experience minimal to no foaming since the liquid will not be forced directly against the bottom of container 12. The flow discharge pattern of liquid emanating from lance 48 is much akin to that achieved by tipping a beer mug such that the beer flowing from a spout of a keg follows the inner wall of the mug down to the bottom, thereby minimizing foaming. Because the unique lance assembly of the present invention provides the unique discharge flow pattern of the liquid thereby minimizing foaming, subsurface filling with all the attendant problems is unnecessary. Moreover, there is no necessity to initially start with a slow or dribble fill of liquid since it is not necessary to cover the lance tip before the fast fill mode.

Since the input signal to positioner 44 is directly related to the output signal from computer 26, as determined by the control equation or program, the position of the valve element of valve 36, i.e. the flow area of the orifice, is likewise related to the amount of liquid already in container 12. Accordingly, once the preselected amount of liquid has been introduced, i.e. the control parameter, the system can be programmed to commence with a fast fill rate, the fast fill rate being maintained until, for example, ninety percent of the desired final fill weight has been achieved. At this point, rather than, as in the case of prior art systems, the system switching to a second, slower or dribble fill rate to complete the fill cycle, valve 36 can be gradually closed or throttled, i.e. the flow area of the orifice pinched down, the flow rate of liquid being therefor gradually reduced until the desired fill weight is reached to complete the fill and weigh cycle. Not only does this greatly increase the speed of filling, since it is unnecessary to go through a prolonged fixed rate, dribble fill time lag, it eliminates the water hammer effect since the fast fill cycle need not be suddenly stopped in order to switch to the slower dribble fill mode. In prior art systems such as disclosed in the aforementioned U.S. patents, it is necessary to partially fill the container with liquid in the fast fill mode to a weight less than the desired fill weight and then fill to target weight with a second dribble fill rate to eliminate overshoot of liquid into the container. With the present system, there is no problem of overshoot presented since as the weight of liquid in the container approaches the target or desired value, valve 36 can be gradually throttled in any desired increments until the actual, desired final fill weight is reached.

Using the apparatus of the present invention there is no necessity to resort to subsurface filling. Accordingly, the present invention eliminates the complicated prior art system used for withdrawing an elongated lance as the filling continues. Elimination of subsurface filling provides distinct advantages. It will be appreciated, as pointed out above, that in subsurface filling, as the liquid level in the container rises, the lance is slowly withdrawn to maintain discharge from the lance below the surface of the liquid in the container. The lance of the present invention, as can be seen, protrudes into container 12 only a short distance. Accordingly, there is virtually no portion of lance 48 which is below the surface of liquid in the drum. Accordingly, no complicated logic circuitry is required to withdraw the lance at a programmed rate as a function of the level of liquid in the container. Indeed, the lance of the present invention has essentially two positions—the fill position shown in full in FIG. 2 and the nonfill or quiescent position shown in phantom in FIG. 2. Thus, when the desired weight of liquid in the container has been achieved, a control signal from panel 25 to rotary actuator 50 will result in retraction of lance 48 from drum 12 to the position shown in phantom in FIG. 2 where it will remain until the next fill cycle commences. Another distinct advantage of the novel lance 48 of the present invention is that because little or none of the lance is below the surface of liquid in the container even when the desired fill weight has been achieved, there is no need for a wiper ring, virtually an absolute necessity in prior art systems employing long, spearlike lances. A further outstanding advantage of the lance of the present invention is that when the lance is moved to the non-fill position shown in phantom in FIG. 2, virtually none of the liquid contained in the lance will empty into container 12 or for that matter into drip tray 52. In prior art systems such as disclosed in the above-discussed U.S. patents, because of the elongate nature of the lance, there is a considerable volume of liquid retained in the lance when it is withdrawn from the container being filled. Thus, even when the main valve controlling flow of liquid into the container is in the off position with no flow therethrough, the liquid in the lance can empty into the container causing an overshoot of weight. To circumvent this problem, and as discussed above with reference to the prior art devices, a foot valve assembly has been employed which prevents emptying of the elongate lance after the control valve has been shut off. The lance of the present invention eliminates the need of a foot valve assembly or other means used to prevent emptying of the retained liquid in the lance.

While the filling lance of the present invention has been described above with particular reference to a hook-shaped lance and, more specifically, a J-shaped lance, it is to be understood that other configurations of the filling lance can be employed, albeit with less facility. The object is to provide a filling lance which can be rotated or pivoted from a non-fill to a fill position, without reciprocate or vertical movement thereby eliminating lance carriages, carriage stanchions and the like which are conventionally used to reciprocate elongate, spear-like filling lances. The lance should also be such that when it is rotated to the fill position and the discharge opening of the lance is received in the container to be filled, the portion of the lance which extends into the container will lie adjacent the wall of the container nearest the side opening or bunghole of the container such that the liquid will be discharged generally down the side wall. It will be apparent that, accordingly, the lance assembly must have a first run portion and a second run portion which are angularly disposed relative to one another. Although, depending on the relative cross-sectional sizes of the lance and the bung, the length of the arc of rotation, etc., it is possible to utilize a lance assembly in which the first and second run portions are at an obtuse angle with respect to one another, it will be apparent that as a practical matter, lance assemblies wherein the first and second run portions are generally disposed at angles of 90° or less with respect to one another are preferred. Thus, a filling lance wherein the first run portion and second run portion are at an acute angle with respect to one another is especially preferred. The hook-shaped configuration, especially a J-shaped configuration, is particularly desirable as it provides a lance which can be made relatively short and which can pivot around a relatively short arc. However, it is to be understood that any configuration which permits the lance to be pivoted about a generally horizontal axis between fill and non-fill positions, which requires that only a small portion of the lance be introduced interiorly of the container during the fill cycle, and which will generally direct the liquid substantially down the side wall of the container will function.

Figure 3:
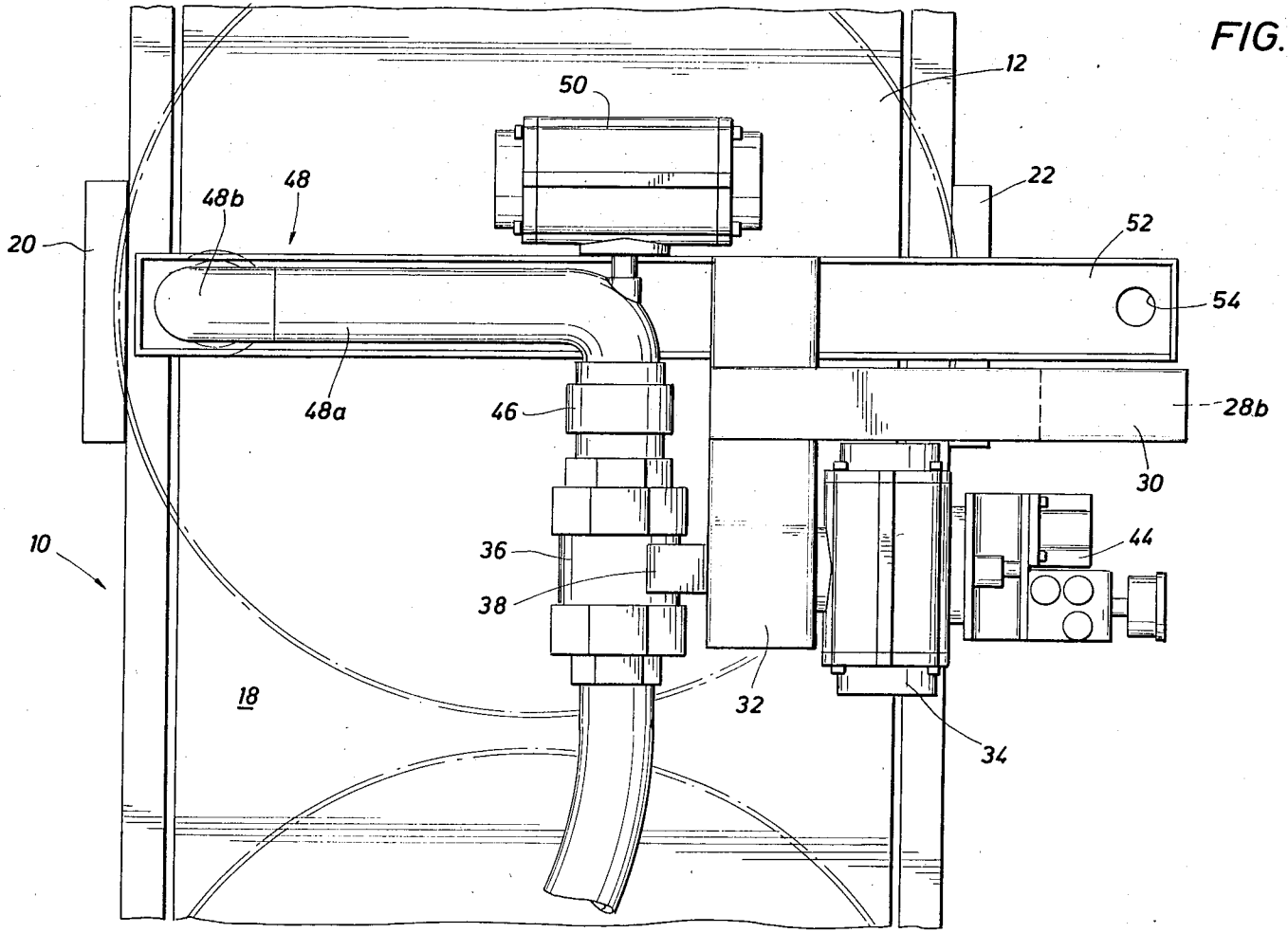
FIG. 3 is a view taken along the line 3—3 of FIG. 2.

As was also pointed out in discussing the filling systems of the prior art, an elaborate drip tray assembly was used, the drip tray being programmable, i.e. movable, so as to catch any drops, including liquid retained in the filling lance when the filling cycle was complete. Such a programmable, movable drip tray assembly again requires elaborate circuitry and poses maintenance problems. In the filling apparatus of the present invention, drip tray 52 is mounted, as best shown in FIGS. 2 and 3, so as to be disposed above lance 48 when lance 48 is moved to the non-fill position shown in phantom in FIG. 2. Accordingly, in the event any liquid retained on lance 48 should drip as the lance is being retracted to the non-fill position, or when it is the non-fill position, will fall into fixed drip tray 52 and can be recovered via drain 54 and returned to the liquid source. Lastly, the filling apparatus of the present invention utilizes a very simple fume hood assembly. Indeed, it should be noted that the only portion of lance 48 which is ever out of fume hood 58 is shorter leg portion 48*c* which extends into container 12 when the lance is in the fill position. While in the non-fill or quiescent position, lance 48 is totally within fume hood assembly 58. Since the primary source of noxious fumes from any liquid being handled by the apparatus is lance 48, such fumes can be effectively contained and disposed of by means of vent 60.

In the embodiments shown in FIGS. 1–3, lance 48, at all times overlies and enters container 12 by being rotated about a point generally overlaying the top of container 12 so as to enter side bung 12*a*. The present invention also contemplates a conduit assembly including a hook-shaped lance such as lance 48 wherein entry into side bung 12*a* would be effected by rotating a lance such as lance 48 from a position wherein lance 48, in the non-fill position, did not overlay the top of container 12. In such a case, the shorter leg portion 48*c* would enter bung 12*a* such that it would be angled generally toward the inner wall of container 12 as opposed to being angled generally away from the wall toward the central portion of the interior of container 12 such as shown in FIG. 2. In such a modified lance assembly, the discharge opening of the lance could be essentially at the end of shorter leg portion 48*c* since the fluid discharge would then essentially follow the same path as that shown in FIG. 2, i.e. generally in a downward path along the inner wall of container 12. In either event, it will be appreciated that lance 48 must be generally hook-shaped in configuration, the general J-shape of lance 48 being especially preferred for the particular configuration shown in FIGS. 1, 2 and 3.

It can also be seen that the filling apparatus of the present invention is structurally considerably simpler than prior art devices. Thus, there is no necessity for the need of vertically disposed tracks or guides having movable carriages to move control valves and filling lances. Attendant lift cylinders and stanchions are likewise eliminated. Because of the unique configuration of the filling lance of the present invention, overhead or head room requirements are greatly reduced. In prior art devices, to retract an elongate filling lance which may be as long as three to four feet in length, considerable overhead space was needed to accommodate withdrawal of the lance from the container when the filling cycle was completed. The unique pivoting, hook-shaped lance of the present invention requires only a minimum amount of head room. The filling system of the present invention also eliminates the need for flex lines interconnecting the valve system with the filling lance. In prior art systems, since the filling lance and control valve were vertically, but movably independently of one another, it was absolutely necessary that connection therebetween be by means of flex lines.

The interfacing arrangement of the present invention which, generally speaking, is a flow proportional control system permits virtually unlimited control of valve opening and liquid feed rate into the container. The interfacing arrangement of the present invention is vastly superior to prior art digital interfacing arrangements which have been used in the automatic filling of containers. Using such digitized systems, fill rates, whether fast or slow, are constant and accordingly changes in fill rate can only be accomplished in stepwise fashion. In essence, the interfacing arrangement utilizes a feedback control loop which monitors the changing weight of liquid and in response to that changing weight calculates an output signal which can be varied in any desired manner as a function of the control equation or program used in the computer of the interfacing arrangement. The control equation, embodied in the software which runs the computer of the interfacing arrangement can be varied, unlike digital systems, so as to provide any fill rate profile. Thus, for example, using an appropriate control equation or software, the system can be programmed to fill at a fast rate until a certain desired point is reached at which time a virtually continuously decreasing fill rate can be employed, the fill rate ultimately falling to zero when the desired weight has been achieved.

While the conduit assembly or lance of the present invention is particularly useful with the filling apparatus described herein utilizing a flow proportional interfacing controller, it will be recognized that the lance assembly can be used with advantage in prior art filling systems using conventional fast-slow-off or slow-fast-slow-off fill cycles. Indeed, the use of the unique lance assembly of the present invention in conventional prior art filling devices would eliminate the need for subsurface filling and its attendant slow-fast-slow-off fill cycle.

The foregoing description represents only one preferred embodiment of the invention, and it should be understood that numerous modifications could be made within the spirit of the invention. Accordingly, it is intended that the scope of the present invention be limited only by the claims which follow.

What is claimed is:

1. An apparatus for filling a container to a predetermined weight with a liquid from a liquid source while generating a minimum amount of foam comprising:

scale means operational to generate a control signal based on the weight of said liquid within said container and a control equation;

control valve means in flow controlling relationship between said liquid source and said container, said valve means having a movable valve element permitting selectively a calculated variable flow rate therethrough;

actuator means operatively associated with said control valve for moving said valve element to vary said flow rate;

valve positioner means operatively associated with said actuator means to control operation of said actuator means in response to a calculated positioning signal;

an interface arrangement operatively associated with said scale means and said positioner to generate said positioning signal, said positioning signal being a calculated signal which is a formation of said control signal and a control program;

a conduit assembly for introducing said liquid into said container from said liquid source through said valve means and including a filling lance having a first run portion interconnected to a second run portion, said first run portion and said second run portion being angularly disposed with respect to one another, said filling lance being mounted for pivotal movement about a generally horizontal axis transverse to and extending generally through the end of said first run portion distal said second run portion; said second run portion having a free end distal said first run portion and a discharge opening generally transverse to the axis of said second run portion and away from said first run portion whereby said filling lance can be moved to a position such that said liquid is discharged through said discharge opening in a generally downward and outward path toward a side of said container; and means for pivoting said lance between filling and non-filling positions.

2. The apparatus of claim 1 wherein said first run portion and said second run portion of said lance are interconnected by a radiused portion, said second run portion being at an acute angle to said first run portion.

3. The apparatus of claim 1 wherein said conduit assembly includes a swivel joint assembly interconnecting said control valve means and said lance.

4. The apparatus of claim 1 wherein said discharge opening is located closely adjacent said free end of said second run portion and generally faces away from said first run portion.

5. The apparatus of claim 1 wherein said filling lance is generally hook-shaped.

6. The apparatus of claim 1 wherein said means for pivoting said lance includes means to pivot said lance from a first position wherein said first run portion is in a generally vertical non-filling position to a second position wherein said first run portion is in a generally horizontal filling position.

7. The apparatus of claim 1 further including a fume disposal assembly, said lance being contained and movable within said fume disposal assembly.

8. The apparatus of claim 1 further including a drip collection assembly fixedly disposed beneath said lance so as to collect drops of said liquid from said lance, said drip collection assembly including a generally horizontally disposed drip collection pan, said drip collection pan having an opening therein whereby said second run portion of said lance can extend through said opening into a bunghole of a container.

9. In an apparatus for filling a container to a predetermined weight with a liquid from a liquid source, said apparatus including a weighing system and a control valve system in flow controlling relationship between the liquid source and the container in response to said weighing system and without overfilling, splashing or foaming the liquid, the improvement comprising:

a support means;

a conduit assembly mounted on said support means for introducing said liquid from said liquid source into said container, said conduit assembly being in flow communication with said valve system and including a filling lance, said filling lance including a first run portion interconnected to a second run portion, said first run portion and said second run portion being angularly disposed with respect to one another, said filling lance being mounted for pivotal movement about generally horizontal axis transverse to said first run portion and extending generally through the end of said first run portion distal said second run portion; said second run portion having a free end distal said first run portion and a discharge opening generally transverse to the axis thereof and directed away from said first run portion whereby said filling lance can be moved to a position such that said liquid is discharged through said discharge opening in a generally downward and sideward path to impinge upon a side wall of said container.

10. The apparatus of claim 9 wherein said first run portion and said second run portion of said lance are interconnected by a fixed radiused portion, said second run portion being at an acute angle to said first run portion.

11. The apparatus of claim 9 wherein said conduit assembly includes a swivel joint assembly interconnecting said control valve means and said lance.

12. The apparatus of claim 9 wherein said discharge opening is located closely adjacent said free end of said second run portion.

13. The apparatus of claim 9 wherein said filling lance is generally hook-shaped.

14. The apparatus of claim 9 wherein said means for pivoting said lance includes means to pivot said lance from a first position wherein said first run portion is in a generally vertical disposition to a second position wherein said first run portion is in a generally horizontal disposition.

15. An apparatus for filling a container to a predetermined weight with a liquid from a liquid source while preventing overflow, spillage and/or foaming of said liquid, said apparatus comprising:

container weight sensing means capable of generating a control signal responsive to weight sensed of said container and contents thereof;

liquid delivery means to dispense liquid from said liquid source into said container and including conduit means connected to said liquid source, valve means having an input connected to said conduit means, valve actuator means connected to said valve means and operative in response to said control signal, and a filling lance connected to an output of said valve means, said filling lance having a first run portion and a second run portion interconnected by a fixed radiused portion defining an acute angle therebetween, said filling lance being mounted for pivotal movement about a generally horizontal axis transverse to and extending generally through the end of said first run portion distal said second run portion, said second run portion having a free end distal said first run portion and a discharge opening generally transverse to the axis of said second run portion and away from said first run portion whereby said filling lance can be rotated from a substantially vertical non-filling position to a substantially horizontal filling position in which said second run portion extends at least partially through a bung of said container to discharge said liquid against a side wall thereof.

* * * * *